United States Patent [19]

Conner, Sr.

[11] 4,233,176

[45] Nov. 11, 1980

[54] NON-PETROLEUM BASED METAL CORROSION INHIBITOR

[76] Inventor: Alvin J. Conner, Sr., 2156 Agriculture St., New Orleans, La. 70122

[21] Appl. No.: 37,418

[22] Filed: May 9, 1979

[51] Int. Cl.[2] ..... C23F 11/14; C23F 11/12

[52] U.S. Cl. ..... 252/392; 106/14.13; 106/14.15; 106/14.18; 148/6.14 R; 422/7; 422/12; 422/16; 422/17; 427/388.1; 428/457; 428/543

[58] Field of Search ..... 252/392, 396; 106/14.13, 14.15, 14.18; 422/7, 12, 16, 17; 148/6.14 R; 428/457, 543; 427/388 R

[56] References Cited

U.S. PATENT DOCUMENTS

| | | | |
|---|---|---|---|
| 3,378,488 | 4/1968 | Nimerick | 252/392 |
| 3,977,994 | 8/1976 | Geiser | 252/392 |
| 4,072,783 | 2/1978 | Yasue et al. | 428/457 |
| 4,074,013 | 2/1978 | Koch et al. | 252/392 |
| 4,130,524 | 12/1978 | Boerwinkle et al. | 252/392 |

*Primary Examiner*—Benjamin R. Padgett
*Assistant Examiner*—Irwin Gluck
*Attorney, Agent, or Firm*—Armstrong, Nikaido, Marmelstein & Kubovcik

[57] ABSTRACT

A non-petroleum based metal corrosion inhibitor, a process for preparing the inhibitor, a method of applying it to metal surfaces and advantages of the inhibitor and of surfaces which are coated with it are presented. The inhibitor is a solution of compounds mixed together in particular proportions to form a non-petroleum based coating for preventing, or inhibiting, the oxidation of metals. The solution is prepared from organic monobasic acids, a lubricant, a mixture of amines, and water. The solution is applied by spraying or rolling over the surface of steel or other metal. The coating inhibits oxidation of the metal surface and need not be removed from the surface prior to painting.

16 Claims, No Drawings

NON-PETROLEUM BASED METAL CORROSION INHIBITOR

BACKGROUND OF THE INVENTION

1. Field of the Invention

This invention relates to compositions which inhibit the corrosion or oxidation of metal surfaces. More particularly, this invention relates to a non-petroleum based metal corrosion inhibitor.

2. Description of the Prior Art

Metal industries and, particularly, the steel industry are plagued with the problem of corrosion, e.g., rusting, of metal products, especially sheet products. With the more refined methods of producing higher grade steel sheets for use in automobiles, appliances and allied industries, the problem of rusting during the manufacturing process, storage and shipment has become a significant one.

Various means have been and are being employed to combat this problem. Inhibited petroleum based oils are widely used as coatings for inhibiting the corrosion of various steels. This type of protection, however, is becoming increasingly impractical due to cost, the hazardous conditions created by the use of the petroleum based coatings, difficulty in removing the coatings and difficulty in disposing of the oil following its removal from the steel. Additionally, so-called smudging is sometimes caused by the polymerization and oxidation of petroleum based inhibitor compositions. Since the surface of steel is microscopically porous, sufficient oil is absorbed into the surface to cause such smudging even after removal of the petroleum based inhibitor. In spite of these problems, these oil coatings continue to be used since they provide the required protection against corrosion and also serve to provide lubrication.

It is an object of the present invention, therefore, to provide a non-petroleum based metal corrosion inhibitor that will provide protection against oxidation and will provide lubricity equivalent or superior to that of petroleum based inhibitors when applied to metal surfaces but which will not possess the undesirable characteristics of such inhibitors.

This and other objects and advantages of the present invention will become apparent to those skilled in the art from the following summary and description of preferred embodiments of the invention.

SUMMARY OF THE INVENTION

According to the present invention, there is provided a metal corrosion inhibiting composition which is water based solution of:

(1) $C_8$–$C_{20}$ organic, monobasic acids;
(2) lubricant;
(3) an aminoalkylalkanolamine or mixtures thereof;
(4) benzoic acid; and
(5) an amine which forms a water-soluble salt with benzoic acid.

The composition can be applied to the metals by spraying or rolling.

The composition according to the present invention is generally prepared as a concentrated aqueous solution containing from about 25 to about 65% by weight of components (1)–(5). For application to metal surfaces, this concentrate is generally diluted up to about 5 times with water, i.e., 5 parts of water to 1 part of the concentrate. The composition offers protection against oxidation to aluminum, zinc coated or galvanized steel, aluminum coated steel, tin plated steel, stainless steel, high carbon electrical grade steel cold rolled carbon steel and the like.

DESCRIPTION OF PREFERRED EMBODIMENTS

The non-petroleum based corrosion inhibiting composition according to the present invention, including a preferred composition which contains a minor amount of a petroleum oil, appears to be an aqueous solution of the various components. The exact mechanism of the formation of the solution, however, is not known.

Relatively high molecular weight organic, monobasic acids are employed in preparing the non-petroleum based composition according to the present invention. Organic acids having from about 8 to about 20 carbon atoms have been found to be useful in preparing the composition. These organic acids include fatty acids, both saturated and unsaturated, such as caprylic acid, palmitic acid, stearic acid, oleic acid and linoleic acid and resin acids such as abietic acid and acids isomeric therewith. These acids can be used alone or in combination.

In a preferred embodiment of the invention, a mixture of tall oil fatty acids and rosin, because of its availability and cost and the properties of the resultant corrosion inhibiting composition, is used as the high molecular weight organic acid component of the composition. Such mixtures are obtained as a byproduct of the paper industry from tall oil usually recovered from pine wood "black liquor". Oleic and linoleic acids are the major components of the tall oil fatty acids with acids such as palmitic acid, isostearic acid and stearic acid being present in relatively minor amounts. In a typical mixture of tall oil fatty acids and rosin useful in the present invention, oleic acid and linoleic acid comprise about 45% and 35% by weight, respectively, of the fatty acids. Rosin is mainly comprised of isomeric forms of abietic acid. The rosin can be present in an amount of from about 5 to 40% by weight; preferably, 10 to 40% by weight, of the tall oil fatty acid/rosin mixture. Mixtures containing less than about 5% by weight of rosin cannot be used because of problems relating to viscosity. Increased amounts of rosin appear to decrease the viscosity of the corrosion inhibiting composition. Mixtures containing more than about 40% rosin are not economical.

Other mixtures of organic acids such as tallow, the major constituents of which are oleic, palmitic, stearic, myristic and linoleic acids, can also be employed in preparing the non-petroleum based corrosion inhibiting compositions according to the present invention. The high molecular weight organic, monobasic acid component of the corrosion inhibiting composition is employed in an amount of about 5 to 20 parts by weight based on about 100 parts by weight of the concentrated solution.

The composition according to the present invention typically contains a minor amount of a lubricant which may be either a petroleum or a non-petroleum product. Any of the petroleum oils presently employed in petroleum based corrosion inhibiting compositions for steel are believed to be useful in the present composition. Good results have been using a 100 SSU viscosity petroleum oil. In lieu of a petroleum oil, esters such as butyl stearate, dioctyl sebacate, butyl benzoate, or any of the light alkyl esters with boiling ranges above 350°

F. can be used as the lubricant. In a particularly preferred embodiment a petroleum oil is used as the lubricant. To obtain a stable aqueous solution of the composition the amount of lubricant is limited by the amount of the high molecular weight organic acid. More particularly, the lubricant is employed in an amount of from about 10 to 20% of the organic acid, i.e., 0.5 to 4 parts by weight per 100 parts by weight of the concentrated solution. Amounts of greater than about 20% are not completely solubilized in the composition.

The aminoalkylalkanolamine of the metal corrosion inhibiting compositions according to this invention has the following general structure formula:

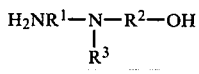

$$H_2NR^1-\underset{\underset{R^3}{|}}{N}-R^2-OH$$

wherein $R^1$ and $R^2$ are independently alkylidene of 1–4 carbon atoms and $R^3$ is hydrogen or alkyl of 1–4 carbon atoms. One or more of these aminoalkylalkanolamines can be employed in the non-petroleum based inhibitor composition according to the present invention. Aminoethylethanolamine is presently preferred because of its cost and the good results that it provides. The amount of the aminoalkylalkanolamine appears to be important to obtaining a stable composition which is completely clear, will not stratify or separate and which can be diluted up to about 5 times its weight with water and also appears to be within about 10 to 20% by weight of the organic acid, i.e., 0.5 to 4 parts by weight per 100 parts of concentrated solution. Suitable amounts, however, can be determined by the skilled chemist, in conjunction with the particular components employed and the description of the preparation of the composition which follows.

The metal corrosion inhibiting composition according to the present invention includes as an inhibitor a water-soluble salt of benzoic acid. Although it is believed that virtually any amine which forms a water-soluble salt with benzoic acid can be used in the composition according to the present invention to provide corrosion inhibiting properties, particularly good results have been obtained with the use of (lower ($C_2$–$C_4$) alkanol)amines and, particularly, monoethanolamine and diethanolamine. Other suitable amines are diisopropylamine, cyclohexylamine and morpholine. The amines can be used alone or in combination. In addition to forming a salt with the benzoic acid, the amine also forms salts with the organic acids and appears to saponify the organic acid/lubricant components. The amine, therefore, is generally used in an amount in excess of the amount required to neutralize the benzoic acid. Good corrosion inhibiting effects have been obtained employing about 10 to 35 parts and, particularly, 24 to 35 parts of the benzoic acid per 100 parts by weight of the concentrated solution. The amount of the amine, excluding the alkylaminoalkanolamine, therefore, is about 5 to 20 parts by weight and preferably, 15 to 20 parts, based on 100 parts by weight of the concentrated solution.

Although the amounts of the high molecular weight monobasic organic acid, lubricant, benzoic acid and salt-forming amines can vary within the ranges described above, for practical use as a concentrate, these non-aqueous components of the compositions should be employed in an amount of from 25 to 65 parts per 100 parts by weight of the concentrate. In particularly preferred compositions, these components are used in an amount of from 55 to 65 parts by weight of the concentrate; the remainder of the concentrate being water. To facilitate application of the corrosion inhibiting compositions to the metal surfaces, the concentrated solutions are diluted up to 5 times, preferably about 4 times, with water, i.e., up to 500 parts of water per 100 parts of the concentrate.

The sequence of addition of the various components is important to get a finished product which is clear, stable and which can be diluted to produce a stable product for final use.

Generally, the mixture of the above-described monobasic organic acid component and lubricant are added to the water with stirring in a suitable mixing device. This is followed by the addition of the aminoalkylalkanolamine which causes the formation of a cloudy emulsion. An amount of the amine (which forms the water-soluble salt with benzoic acid) in excess of that required to form a clear solution from the cloudy emulsion is then added followed by the benzoic acid and the remainder of the salt-forming amine. In another variation, a solution of the benzoic acid and salt-forming amine can be added to a solution of the monobasic organic acid-lubricant-aminoalkylalkanolamine. A unique characteristic of the present invention is that following these procedures, a lubricant, either natural or synthetic, can be completely solubilized in water when the amounts of the components of the non-petroleum based inhibitor concentration are maintained within the ranges described above.

The preparation of a typical 55 gallon batch of a concentrated solution of the non-petroleum based corrosion inhibitor is as follows (approximate weights are in parenthesis):

Pump 30 gallons of water (250 lbs) at 120° F. into tank and agitate. Add 10 gallons of a tall oil fatty acid/rosin mixture (80 lbs) sold under the tradename Unitol-DT-40 by Union Camp and 1 or 2 gallons of 100 SSU viscosity petroleum oil (7–14 lbs). The oil will dissolve in the tall/oil-rosin mixture, but neither the petroleum oil nor the tall oil fatty acid/rosin mixture will dissolve in the water. While agitating add one gallon of aminoethylethanolamine (8 lbs). An oil in water emulsion will form. This emulsion is milky and completely opaque. Add 8 gallons of monoethanolamine (64 lbs) and the mixture will become clear and stable. Add 100 pounds of benzoic acid and the mixture will become hazy because of the portion of the benzoic acid which has not been neutralized to a soluble salt. To complete neutralization of the benzoic acid, add more monoethanolamine (or morpholine, cyclohexylamine, etc.) until the solution is completely clear and has a pH of 8.0 to 9.5. Continuing mixing for 30 minutes and recheck pH. If pH drops below 8.0, add more monoethanolamine to bring pH to 9.0.

For use at the mills or manufacturing plants, one part of the above composition is diluted with up to 5 parts of water and applied as either a rust preventative or lubricant. The recommended dilution ratio is 1 part concentrate to about 4 parts water.

Preferred compositions according to the present invention are formed by the sequential addition of the following compounds to 250 lbs (about 30 gallons) of water with stirring (weights are approximate):

(a) tall oil fatty acids/rosin—80 lbs (b) petroleum oil (100 SSU viscosity—7–14 lbs (c) aminoethylethanolamine—8 lbs
(d) monoethanolamine—16 lbs
(e) benzoic acid—150-200 lbs
(f) monoethanolamine—75-100 lbs and
(a) tall oil fatty acids/rosin—40 lbs
(b) petroleum oil—3.5-7 lbs
(c) aminoethylethanolamine—41 lbs
(d) monoethanolamine—8 lbs
(e) benzoic acid—150-200 lbs
(f) monoethanolamine—50-75 lbs
(g) diethanolamine—43 lbs.

The above formulations use only 1 or 2 gallons of petroleum oil per fifty-five gallon batch of concentrate. When the concentrated solution is diluted four to one with water, it acts as a direct replacement for oil and replaces up to 200 gallons of oil for each gallon of oil used in the 200 gallons solution. Actual tests have shown that when used as a replacement for oil, one quart of the solution replaces two gallons of oil, so the overall use of oil by steel mills is reduced considerably.

With the cost of petroleum increasing dramatically, the savings through the use of the compositions described herein are considerable. Also, large quantities of petroleum can be released for more important uses.

Another advantage of this solution over petroleum-based inhibitors is that the petroleum-based compositions must be removed from the steel before it can be painted. When degreasing is performed, chlorinated solvents, such as trichloroethylene or perchloroethylene are used. Both are suspected carcinogens and usage of each is now restricted. EPA and OSHA have severely reduced the permissible limits of these substances in the atmosphere. Degreasing is also expensive. Oil disposal also presents an expensive problem. When washing is exercised to remove the oil, detergents and caustic solutions must be used. The wash water and oil cannot be discharged into the drainage systems.

The composition according to the present invention does not have to be removed from the surface of metals prior to painting in most cases. However, when it must be removed, water will remove it from the surface. The water can be discharged into drains since the solution is biodegradable.

The application of the petroleum-based inhibitor compositions at the mills creates further hazards because for every gallon of oil which is applied, some will drip off and create unsafe working conditions. When the oil is applied to sheets which are coiled, oil is spread throughout the area because of the centrifugal motion of the coiling operation. Solvents are used to clean the work area, which may create additional hazards. These operations are eliminated with the use of the non-petroleum based corrosion inhibiting compositions according to the present invention.

When employed in a steel making operation, the inhibitor composition of the present invention should be applied after pickling and hot roll reduction operations, and prior to cold reduction, because the cleaned pickled sheet is very susceptible to rusting. Reapplication of the composition after the final reduction protects the coils during storage prior to annealing. The composition can be reapplied at the temper mill operation, either on the entry or exit side of the temper mill. When the composition is applied at the entry side, a very fine mist application is desirable so as not to cause problems on the temper mill rolls. The composition is applied at the exit side of the temper mill either as a light or heavy spray. This also applies when the solution is applied at the stretch or shear line.

Tests in a humidity cabinet on coils stored for two months show that the protection afforded by the non-petroleum based corrosion inhibitor composition of the present invention is as good, or better, than conventional inhibited oils.

EXAMPLES

To illustrate the corrosion inhibiting properties of the non-petroleum based corrosion inhibitor compositions according to the present invention when applied to steel, the following compositions were prepared according to the general procedures described above. In the compositions, percentages are by weight and the tall oil fatty acids/rosin mixtures employed are commercially available compositions in which the fatty acids are composed primarily of a mixture of oleic and linoleic acids:

(1)
(a) Tall oil fatty acid (TOFA)60%; rosin 40%—1-2-18%
(b) 100 SSU Vis Petroleum Oil—2-4%
(c) Amine mixture: 40% aminoethylethanolamine (AEE), 60% monoethanolamine (MEA)—5-10%
(d) Benzoic acid—10-20%
(e) Water—71-48%
(2)
(a) TOFA 60%; rosin 40%—12-18%
(b) 100 SSU Sec Petroleum Oil—2-4%
(c) Amine mixture: 40% AEE, 50% MEA, 10% Morpholine—5-10%
(d) Benzoic acid—10-20%
(e) Water—71-48%
(3)
(a) TOFA 70%; rosin 30%—12-18%
(b) 100 SSU Sec Petroleum Oil—2-4%
(c) Amine mixture: 30% AEE, 70% MEA—5-10%
(d) Benzoic acid —10-20%
(e) Water—71-48%
(4)
(a) TOFA 80%; rosin 20%—12-18%
(b) 100 SSU Sec Vis Petroleum Oil—2-4%
(c) Amine mixture: 30% AEE, 70% MEA—5-10%
(d) Benzoic acid—10-20%
(e) Water—71-48%
(5)
(a) Oleic acid 80%, rosin-abietic acid 20%—12-18%
(b) 100 SSU Vis Petroleum Oil—2-4%
(c) Amine mixture: 30% AEE, cyclohexylamine 70%—5-10%
(d) Benzoic acid—10-20%
(e) Water—71-48%
(6)
(a) Caprylic acid 70; abietic acid 30%—12-18%
(b) 100 SSU Sec Vis Petroleum Oil—2-4%
(c) 30% AEE, 70% MEA—5-10%
(d) Benzoic acid—10-20%
(e) Water—71-48%
(7)
(a) TOFA 80%; rosin 20%—12-18%
(b) Butyl Stearate—2-4%
(c) 30% AEE-70% MEA—5-10%
(d) Benzoic acid—10-20%
(e) Water—71-48%
(8)
(a) Tallow Fatty Acid—12-18%
(b) 100 SSU Sec Vis Petroleum Oil—2-4%

(c) 30% AEE, 70% MEA—5–10%
(d) Benzoic acid—10–20%
(e) Water—71–48%
(9)
(a) Tallow Fatty Acid 80%; rosin 20%—12–18%
(b) 100 SSU Sec Vis Petroleum—2–4%
(c) 30% AEE, 70% MEA—5–10%
(d) benzoic acid—10–20%
(e) Water—71–48%
(10)
(a) TOFA 70%; rosin 30%—12–18%
(b) 100 SSU Sec Vis Petroleum Oil—2–4%
(c) 20% AEE, 80% Diethanolamine—5–10%
(d) Benzoic acid—10–20%
(e) Water—71–48%
(11)
(a) TOFA 70%; rosin 30%—12–18%
(b) 100 SSU Sec Vis Petroleum Oil—2–4%
(c) Diethanolamine—5–10%
(d) Benzoic acid—10–20%
(e) Water—71–48%
(12)
(a) TOFA 70%; rosin 30%—12–18%
(b) 100 SSU Sec Vis Petroleum Oil—2–4%
(c) Diethanolamine—5–10%
(d) Benzoic acid—10–20%
(e) Water—71–48%

These compositions were evaluated for corrosion inhibiting properties according to the testing procedures described below. Data for other corrosion inhibiting compositions are presented for comparative purposes.

TESTING PROCEDURE

Cold roll dry strips ($1\frac{1}{4}''$ wide by 4" long, dry, clean and rust-free) were used as test specimens. A 1/16" hole was punched $\frac{1}{8}''$ from the top and bottom, and $\frac{5}{8}''$ from one side. A hook, fabricated from galvanized wire, was used to hang the strips in a humidity cabinet. Each strip was marked for identification by embossing a number with a metal stamp about $\frac{1}{4}''$ below the punched hole. To standardize the test, a strip as described above was dipped 2" in the solution to be tested and suspended by a metal hook with the dipped or coated portion of the strip at the bottom. The strip was allowed to dry or drain for one hour, and the hook transferred to the opposite end of the strip, which was then suspended on a rack in the humidity cabinet. The coated or dipped end was now on top, and the lower, uncoated end of the strip on the bottom. The conditions in the humidity cabinet were maintained at 100° F. and 100% humidity.

Observations of the strip were made every 24 hours. The lower or dry parts of all strips were completely rusted after 24 hours. All tests were run for 120 hours.

The condition of the coated parts were graded as follows:

A. Completely free of rust
B. Slight rusting on the surface, but less than approximately 2%
C. Rust on approximately 5–10% of the area
D. Completely rusted

| SOLUTIONS TESTED | HOURS IN HUMIDITY CABINET 24 | 48 | 72 | 96 | 120 |
|---|---|---|---|---|---|
| Lubricating - Preservative Oil MIL-L-2160A - Gr 2 | A | A | A | A | A |

-continued

| SOLUTIONS TESTED | HOURS IN HUMIDITY CABINET 24 | 48 | 72 | 96 | 120 |
|---|---|---|---|---|---|
| Lubricating - Preservative Oil MIL-L3150 - Gr 2 | A | A | A | A | A |
| Solvent Cutback MIL-O-16173 - Gr 2 | A | A | A | A | A |
| Uninhibited - 10 Weight Lubricating Oil | A | A | A | B | C |
| 10% Solution - Sodium Nitrite 90% Distilled Water | A | B | B | C | D |
| 10% Solution - Sodium Benzoate 90% Distilled Water | A | B | C | C | D |
| 10% Ammonium Benzoate 90% Distilled Water | A | B | C | D | D |
| 10% Sodium Molybdate 90% Distilled Water | A | B | C | C | D |
| 10% Dicyclohexylamine Benzoate 90% Isopropyl alcohol | A | A | B | B | C |
| 10% Monoethanolamine Benzoate 90% Distilled Water | A | A | A | B | B |
| 10% Diethanolamine Benzoate 90% Distilled Water | A | A | B | B | B |
| Composition No. 1 100% | A | A | A | A | A |
| Composition No. 1 25% Deionized Water 75% | A | A | A | A | A |
| Composition No. 2 25% Deionized Water 75% | A | A | A | A | A |
| Composition No. 3 25% Deionized Water 75% | A | A | A | A | A |
| Composition No. 4 25% Deionized Water 75% | A | A | A | A | A |
| Composition No. 5 25% Deionized Water 75% | A | A | A | A | A |
| Composition No. 6 25% Deionized Water 75% | A | A | A | A | A |
| Composition No. 7 25% Deionized Water 75% | A | A | A | A | A |
| Composition No. 8 25% Deionized Water 75% | A | A | A | A | A |
| Composition No. 9 25% Deionized Water 75% | A | A | A | A | A |
| Composition No. 10 25% Deionized Water 75% | A | A | A | A | A |
| Composition No. 11 25% Deionized Water 75% | A | A | A | A | A |
| Composition No. 12 25% Deionized Water | A | A | A | A | A |

Although the present invention has been described in conjunction with the foregoing preferred embodiments, it is not intended to be limited to these embodiments but, instead, includes all those embodiments within the spirit and scope of the appended claims.

What is claimed is:

1. A non-petroleum based metal corrosion inhibiting composition consisting essentially of a solution of one part by weight of an aqueous concentrate and up to five parts by weight of water, said aqueous concentrate comprising, per 100 parts by weight of the concentrate:

(a) 5 to 20 parts by weight of a monobasic organic acid having from 8 to 20 carbon atoms;
(b) 0.5 to 4 parts by weight of a lubricant;
(c) 0.5 to 4 parts by weight of an alkylaminoalkanolamine of the formula:

$$H_2NR^1-\underset{\underset{R^3}{|}}{N}-R^2-OH$$

where $R^1$ and $R^2$ are independently alkylidene of 1–4 carbon atoms, and $R^3$ is hydrogen or alkyl of 1–4 carbon atoms;

(d) 10 to 35 parts by weight of benzoic acid; and (e) 5 to 20 parts by weight of an amine which forms a water soluble salt with benzoic acid.

2. The composition of claim 1 wherein said monobasic organic acid is selected from the group consisting of oleic acid, linoleic acid, caprylic acid, palmitic acid, stearic acid, myristic acid, abietic acid and mixtures thereof.

3. The composition of claim 2 wherein said lubricant is a petroleum oil or an ester.

4. The composition of claim 3 wherein said lubricant is a 100 SSU viscosity petroleum oil.

5. The composition of claim 4 wherein said amine which forms a water-soluble salt with benzoic acid is selected from the group consisting of alkanolamines, where the alkyl group has 2–4 carbon atoms; cyclohexylamine; diisopropylamine; and morpholine.

6. The composition of claim 5 wherein said monobasic organic acid is a mixture of tall oil fatty acids and rosin or is tallow.

7. The composition of claim 5 wherein said monobasic organic acid is a mixture of tall oil fatty acids and rosin.

8. The composition of claim 7 wherein said lubricant is a petroleum oil.

9. The composition of claim 7 wherein said alkylaminoalkanolamine is aminoethylethanolamine.

10. The composition of claim 9 wherein said amine which forms water soluble salts with benzoic acid is selected from the group consisting of monoethanolamine, diethanolamine, diisopropanolamine and mixtures thereof.

11. The composition of claim 10 wherein said amine is monoethanolamine.

12. The composition of claim 10 wherein said amine is diethanolamine.

13. The composition of any one of claims 1 to 12 wherein the amounts of the components of said aqueous concentrate, per 100 parts by weight of the concentrate, are:

(a) 5 to 20 parts by weight,
(b) 0.5 to 4 parts by weight,
(c) 0.5 to 4 parts by weight,
(d) 24 to 35 parts by weight, and
(e) 15 to 20 parts by weight.

14. The composition of claim 13 wherein the total amount of components (a), (b), (c), (d) and (e) of said aqueous concentrate is 25 to 65 parts per 100 parts by weight of concentrate, the remainder being water.

15. The composition of claim 13 wherein the total amount of components (a), (b), (c), (d) and (e) of said aqueous concentrate is 55 to 65 parts per 100 parts by weight of concentrate, the remainder being water.

16. A formed metal object coated with the corrosion inhibiting composition of claim 1.

* * * * *